United States Patent [19]

Sivachenko et al.

[11] Patent Number: 4,706,319

[45] Date of Patent: Nov. 17, 1987

[54] LIGHTWEIGHT BRIDGE STRUCTURE

[75] Inventors: Eugene W. Sivachenko, 6471 Riverside Dr., Redding, Calif. 96001; Firoze H. Broacha, Lakewood, Colo.

[73] Assignee: Eugene W. Sivachenko, Redding, Calif.

[21] Appl. No.: 939,925

[22] Filed: Sep. 5, 1978

[51] Int. Cl.[4] ..... E01D 19/12

[52] U.S. Cl. ..... 14/73; 14/17

[58] Field of Search ..... 14/73, 17, 1; 52/795, 52/796, 797, 798, 450, 451

[56] References Cited

U.S. PATENT DOCUMENTS

| | | | |
|---|---|---|---|
| 501,534 | 7/1893 | Palmer | 14/73 |
| 1,472,055 | 10/1923 | Drake | 14/73 |
| 1,625,061 | 4/1927 | Trout | 52/798 X |
| 1,970,966 | 8/1934 | Leare | 52/729 X |
| 1,986,122 | 1/1935 | Sargent | 52/797 X |
| 2,039,601 | 5/1936 | London | 52/451 X |
| 2,201,047 | 5/1940 | Moore | 52/729 X |
| 2,245,688 | 6/1941 | Krueger | 52/450 X |
| 2,601,082 | 6/1952 | Ashman . | |
| 2,946,158 | 7/1960 | Seipt . | |
| 3,066,771 | 12/1962 | Wolchuk . | |
| 3,104,194 | 9/1963 | Zahorski . | |
| 3,181,187 | 5/1965 | Kahn | 14/73 |
| 3,260,023 | 7/1966 | Nagin | 14/73 X |
| 3,302,361 | 2/1967 | Oudheusden . | |
| 3,397,497 | 8/1968 | Shea . | |
| 3,425,077 | 2/1969 | Sievers . | |
| 3,534,463 | 10/1970 | Molin | 52/797 X |
| 3,685,229 | 8/1972 | Sale . | |
| 3,732,656 | 5/1973 | Robinsky | 52/797 X |
| 3,812,636 | 5/1974 | Albrecht . | |
| 3,849,237 | 11/1974 | Zetlin | 14/73 X |
| 3,950,910 | 4/1976 | Pobanc | 52/798 X |

*Primary Examiner*—James A. Leppink
*Assistant Examiner*—Matthew Smith
*Attorney, Agent, or Firm*—Townsend & Townsend

[57] ABSTRACT

A slab-type short span bridge constructed of at least one corrugated plate having parallel, longitudinally extending corrugations of a generally trapezoidal cross-section. A layer of concrete which defines the traffic carrying surface of the bridge and a generally flat plate are secured to the corrugated plate. The flat plate can be interposed between the concrete layer and the corrugated plate, or it may be spaced from the concrete layer by the corrugated plate. The flat plate can simultaneously define portions of the corrugated plate. Means is provided for rigidly interconnecting all members of the bridge into a unitary, load carrying structure.

19 Claims, 10 Drawing Figures

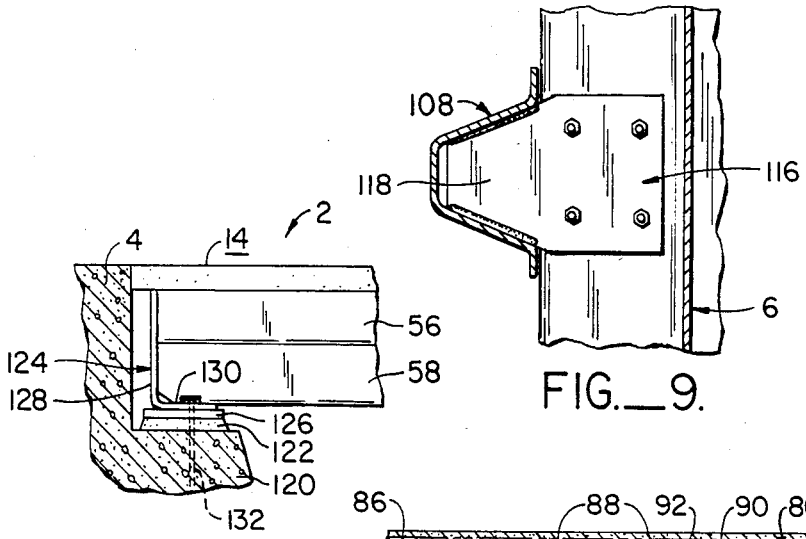
FIG._9.
FIG._10.
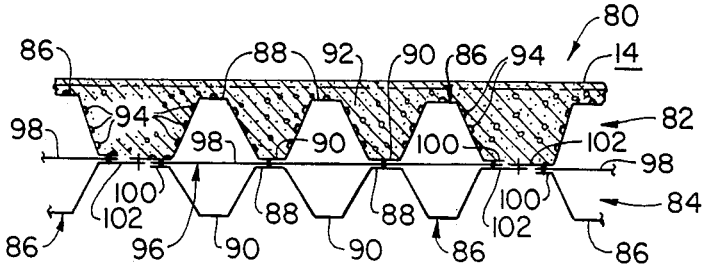
FIG._6.
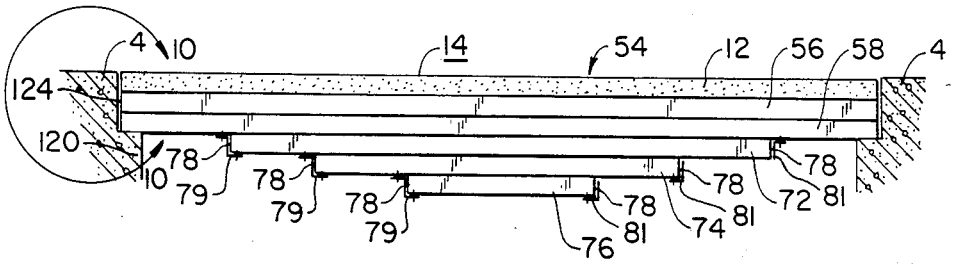
FIG._7.
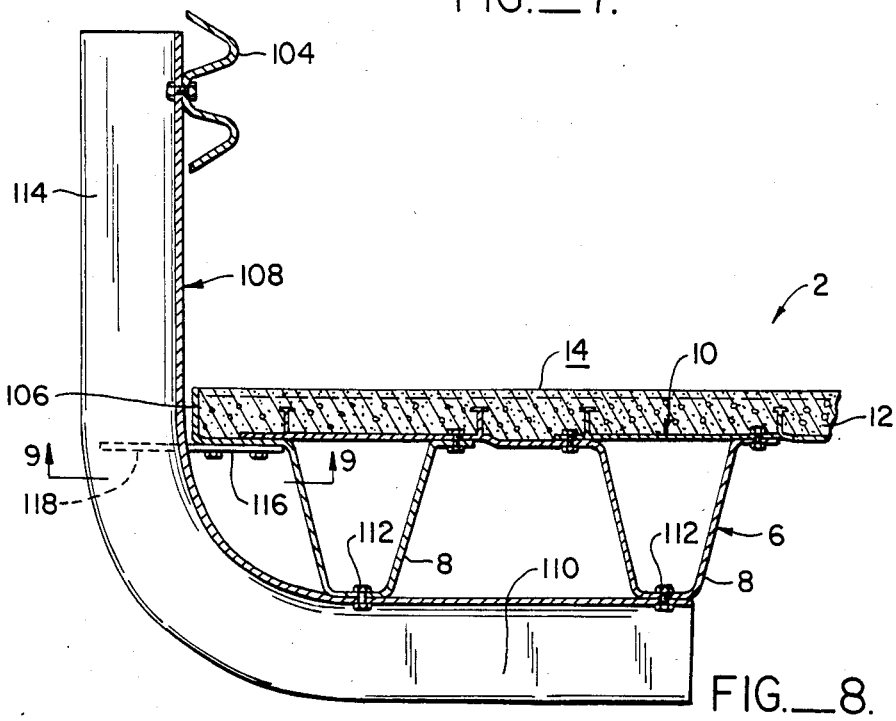
FIG._8.

LIGHTWEIGHT BRIDGE STRUCTURE

BACKGROUND OF THE INVENTION

At the present, there are in the U.S. alone about 105,000 inadequate bridges. A majority of them are functionally obsolete while a lesser number of them are structurally deficient. The latter are defined as bridges which had to be restricted to light vehicles only or closed, while the former are identified as bridges which can no longer safely service the system of which they are an integral part. The replacement cost for these bridges is in the tens of billions of dollars. A majority of these bridges are intermediate and short span bridges having a length of less than 100 feet. A large part and perhaps again a majority of these bridges have lengths of less than about 50 to 60 feet (hereinafter referred to as "short span bridges").

Applicants have recently invented bridge systems which are ideally suited for building bridges of intermediate and long span lengths at relatively low production and erection costs. These systems are expected to greatly facilitate the replacement of such bridges. Although these systems can also be employed for the construction and erection of short span bridges, some of the cost savings experienced with such bridges are reduced or lost when the bridge span becomes too short, primarily because these longer span bridge systems invented by applicants have a strength and rigidity which exceeds that needed for shorter spans.

Generally speaking, prior art short span bridges forego weight savings experienced by fabricating a variety of plates and extrusions into a steel framework and they instead employ as the main load carrying members a plurality of girders made of steel profiles such as channels, I-beams, wide flange beams and the like which are suspended between bridge support points, normally bridge abutments. The girders are suitably tied together to give the bridge lateral rigidity and a bridge deck is placed on top of the girders. The deck may take a variety of forms and may comprise, for example, wood planking placed tranversely to the length of the bridge and suitably secured, e.g. bolted to the girders, steel deck plates and/or a concrete slab which defines the traffic carrying surface of the bridge.

Although such structures are structurally adequate for the intended purpose, they have a large relatively high deadweight. To a large extent this is a result of a structurally relatively inefficient use of the materials in the girders, especially when formed of extruded profiles. Further this is a result of the fact that such bridges typically use only a few, e.g., 2 or 4 relatively widely spaced apart girders. The distance between the girders must be spanned by the bridge deck and the bridge deck must be sufficiently strong to support loads applied to it between adjacent girders. Yet, such relatively heavy decks do not materially strengthen the bridge in a longitudinal direction and must therefore be considered as dead weight which correspondingly increases the strength requirements placed on the girders.

Thus, high material costs, accentuated by the relatively large weight of such bridges together with the high cost of erecting them render short span bridges constructed in accordance with the prior art relatively expensive. This cost, in turn, limits the rate with which the large number of obsolete bridges can be replaced. Accordingly, there is presently a need for short span bridges which are of a lightweight to minimize material consumption and which can be manufactured and erected at a low cost so as to minimize the cost of short span bridges.

SUMMARY OF THE INVENTION

The present invention is specifically directed to short span bridges which are relatively lightweight, yet strong and which can be manufactured and erected at relatively low cost. The bridge of the present invention achieves this by combining all elements of the bridge into a substantially homogenous, load carrying structure, e.g. a structure which exhibits a substantially uniform strength over its entire cross-section at any point along its length. The main load carrying member of that structure is at least one corrugated plate, the corrugations of which are longitudinally oriented and extend between abutments or like supports for the bridge.

The use of corrugated plate as the main load bearing member is of great importance to the present invention. Corrugated plate, as such, of course, has in the past been used for a variety of applications. However, normally it is only used as a secondary structural member for what may be termed light forms of construction such as building floors or building roofs, for example, or the above-discussed bridge decking. In such instances, the corrugated plate is supported by and/or secured to an underlying, corrugated plate supporting framework of girder, trusses, beams and the like.

Difficulties are encountered with corrugated plate when it does not form part of a supporting framework of girders, posts and the like and in particular when the corrugated plate is subjected to large loads such as are encountered, for example, on bridges. First of all, the large bridge loads require corrugated plates which have dimensions much larger than those heretofore encountered and utilized. For a typical short span bridge constructed in accordance with the present invention, the corrugations may, for example, have a corrugation pitch of between 24 to 36 inches, a corrugation depth of between 8 to 12 inches, and a corrugated plate thickness of 3/16th inch.

Secondly, when such a plate is subjected to large point loads, say from the wheels of a heavy truck, the relative lateral weakness of corrugated plate becomes a limiting factor for the plate. In fact, such plate cannot provide for any significant lateral distribution of point loads. Thus, only a fraction of the width of the corrugated plate, namely the corrugation underlying the point load, actually supports the loads. When the narrow width of the corrugated plate is overstressed the corrugation(s) underlying the load spread apart, in other words they effectively collapse. To overcome this by providing supporting girders defeats the objective of reducing the overall weight and complexity of such bridges.

In accordance with the present invention, the relative lateral weakness of corrugated plate subjected to large loads and, in particular, of corrugated plate having relatively large corrugations as above discussed, is overcome by applying to the corrugated plate means which is rigidly secured to one or the other side of the corrugated plate, but preferably it is secured to the upwardly facing side of the bridge and which extends over substantially the full effective width thereof. The plate means has an extent which substantially equals the length and width of the corrugated plate and it (a) distributes point loads in a lateral direction over a plurality of side-by-side corrugations and (b) forms a member which spans open corrugation troughs and, so to speak, ties adjacent corrugations together. In other words, the plate means acts as a tie plate or member for adjacent corrugations which prevents their spreading by being stressed in tension.

In its simplest form, the plate means comprises a flat steel plate that has an effective width substantially equal to that of the corrugated plate. It is placed on top of the corrugated plate and secured thereto so that the two define a unitary structure akin to a slab. Provided the steel plate has the necessary thickness to effect a lateral distribution of point loads, it performs both of the above indicated functions and it may also form the traffic-carrying surface of the bridge. Since the coefficient of friction of flat steel plate is normally too low for vehicular traffic, the upwardly facing surface of the steel plate may be roughened as by incorporating therein a raised diamond pattern. Preferably, however, the flat steel plate is maintained relatively thin so that by itself it would have insufficient rigidity to effect the lateral distribution of point loads. In such a case, a layer of concrete is placed on top of the flat steel plate and suitably anchored thereto so as to form a unitary slab therewith.

The concrete layer may have a thickness of no more than about 3 to 4 inches and it combines with the steel plate to effect the lateral distribution of point loads over a plurality of corrugations. At the same time it defines the traffic-bearing surface of the bridge and gives it the relatively high coefficient of friction that is required for carrying vehicular traffic.

By placing the flat steel plate on top of the corrugated plate and pouring the concrete layer over the flat steel plate, the upwardly opening troughs of the corrugated plate are not filled with concrete when the concrete is poured, thereby significantly reducing the amount of concrete that is placed on top of the bridge and the deadweight of the bridge. This translates into corresponding cost-savings.

It is significant to note that by virtue of the combination of a corrugated plate and of the plate means, the latter normally comprising the above discussed flat tension plate and a layer of concrete, it is possible to employ concrete layers in the construction of bridges which have a thickness which is ordinarily considered totally insufficient for high load applications, even in instances in which the concrete layer does not form the primary load carrying member of the bridge but instead is supported by spaced apart girders because in all such applications, the concrete layer as such is subjected to a bending moment. As a consequence, the lower portion of the concrete layer is in tension where the concrete exhibits relatively little strength. Thus, to attain the required strength prior art structures had to employ greater concrete layer thicknesses coupled with steel reinforcing rods which is relatively expensive.

In contrast thereto, however, the present invention structurally integrates the concrete layer with the flat tension plate and the corrugated plate and positions it so that the concrete layer forms the (relatively thin) top portion of the resulting slab-like structure. Consequently, the concrete is subjected to compression only, a mode in which it can be highly stressed, while the corrugated plate is subjected to tension and compression. The flat plate will be subjected to compression or tension in a longitudinal direction while its function as the above-discussed tie or tensioning member further subjects the flat plate to tension in a lateral direction. In sum and substance, therefore, the present invention combines all structural members in such a manner that each can be stressed in its most advantageous mode, thereby significantly reducing material requirements and making it possible to utilize the resulting structure as the primary load bearing member which does not require the heretofore necessary supporting beams, girders and the like. A bridge constructed in accordance with the present invention is therefore lighter than prior art bridges, it is simpler to assemble and erect and it is relatively stronger than comparable prior art structures. Consequently, the bridge of the present invention offers significant cost savings in terms of its manufacture and erection.

A bridge constructed in accordance with the present invention therefore generally comprises as the sole load carrying members of the bridge, at least one corrugated plate extending over the full length and width of the plate and having longitudinally extending corrugations defined by alternating corrugation peaks and corrugation troughs. Ends of the corrugated plate are placed on suitable supports such as bridge abutments. Further, the bridge includes the above discussed plate means and means for rigidly interconnecting the corrugated plate and the plate means, e.g. the layer of concrete and the flat plate, so as to define a unitary bridge structure.

The means for rigidly interconnecting the corrugated plate and the plate means preferably comprises welds, bolts, rivets or the like for securing the flat plate to the corrugated plate and in instances in which the plate means includes a layer of concrete, means is further provided to form a mechanical interlock between the concrete layer and the flat plate to structurally intergrate all three. This makes it possible to stress the concrete in its most advantageous mode, namely in compression since it then forms the upper part of the homogenous beam or a slab. Further, it enables one to employ the relatively large moment of inertia of the concrete layer in the overall design of the bridge instead of having it represent dead weight only. Of course such an advantageous use of the concrete layer in compression only is only possible if the underlying member is coextensive with the former and rigidly secured thereto; the use of girders or spaced apart, longitudinally extending bridge members as encountered in prior art structures would preclude such a stressing of the concrete layer alone. The corrugated plate of the present invention, which homogenously extends over the full width of the bridge, however, is ideally suited for this construction.

One aspect of the present invention, provides that the corrugated plate be constructed of a plurality of longitudinally extending, parallel and upwardly opening channel members which are arranged side-by-side. Each channel member includes a generally horizontally disposed flange which protrudes laterally from an upper end of the channel and which extends over the full length thereof. The flange has a width which is greater than the lateral spacing between adjoining channel members so that it covers the upwardly opening portion of an adjoining channel member and overlaps the flange of such adjoining member. Means such as welds, bolts, rivets, or the like rigidly secures the overlapping portions of the flanges of the adjoining channel members to each other so that the channel members simultaneously define a corrugated plate that extends over the full length and width of the bridge and the flat plate. The latter is defined by the lateral succession of the horizontally disposed, overlapping and interconnected flanges.

The concrete layer poured on top of the resulting flat plate and means such as anchoring studs are secured, e.g. welded to the flat plate, or a multiplicity of upwardly oriented protruberances and depressions in the plate form a mechanical interlock between the concrete layer and the remainder of the bridge, e.g. the flat plate and the corrugated plate.

According to another aspect of the present invention, the strength of the bridge is increased, particularly for short span bridges of greater length, e.g. having lengths of between 45 to 60 feet by securing additional, lower corrugated plates to the first mentioned, upper corrugated plate. The lower corrugated plates may have the same length as the upper plate or they may be shortened and centered relative to the length of the bridge so as to give the bridge maximum strength at its center between its end supports. Preferably, the lower corrugated plate is secured to the upper corrugated plate so that the two define a plurality of laterally spaced apart, longitudinally extending tubular members to increase the strength and rigidity of the bridge while maintaining a relatively low overall weight. Further, the tubular members may be utilized as protective conduits for cables, pipes and the like while keeping them out of sight and thus increasing the aesthetic overall appearance of the bridge. Ends of the tubular member may be closed to prevent the accumulation of moisture, debris, etc. therein.

For particular applications the flat plate may be secured to the underside of the corrugated plate while the concrete layer is poured directly onto the top of the corrugated plate and mechanically interlocked therewith. In such an instance the concrete layer alone effects the lateral distribution of point loads over a plurality of corrugations while the (lower) flat plate acts as the tie member for the corrugation. Additional, lower corrugated plates are then secured to the upper corrugated plate. This embodiment has the advantage that the bridge has a relatively greater moment of inertia due to the greater amount of concrete that is utilized since in such an instance the concrete will fill the upwardly opening corrugations of the corrugated plate. In all other respects, however, this aspect of the present invention is constructed and functions in the same manner.

Preferably, the metallic components of the bridge, namely the corrugated plate and the flat plate are constructed of corrosion resistant materials such as stainless steel or copper bearing steel as is marketed under the trade designation COR-TEN by the U.S. Steel Corporation of Pittsburgh, Pennsylvania, for example. Briefly, upon exposure to the atmosphere, copper bearing steel surface oxidizes and forms a self-protective coating, thereby providing far superior resistance to atmospheric corrosion. Accordingly, by constructing the plates of such corrosion-resistant materials, thinner cross-section materials can be employed which, in turn, are more readily worked and enable one, for example, to corrugate the material at a lesser cost by cold working it while requiring little or no maintenance over the life of the bridge.

Additionally, it is preferred to construct the corrugated and flat plates used in the bridge of the present invention of relatively high strength steel, for example, steel having a yield strength of at least about 50,000 psi. This enables a further reduction of the wall thicknesses for the plates at a very modest increase in the per pound cost of the material which is substantially out-weighed by reductions in the overall weight.

The perhaps greatest cost savings afforded by the present invention are encountered during the actual assembly and erection of the bridge. To the extent the bridges employ flat plates, they are readily available at very reasonable prices. The corrugated plate, or the above-discussed flanged channel members from which the corrugated plate is formed are readily cold formed by corrugating flat sheet metal stock in suitable corrugating machines. The corrugated plate and the flat plate are then cut to the desired length and secured, e.g., spot-welded to each other, or if channel members are used they are welded together with high speed, automatic welding equipment or the like.

Thereafter the bridge is ready for shipment to the construction site and erection. To facilitate shipment the bridge may be constructed in separate bridge modules of a practical width, say 8 feet. To erect a bridge, all that is necessary is to hoist it into place. If modules are employed they are hoisted into place and assembled, i.e., tied together with welds, bolts or separate transverse tie-strips, for example. Lastly, the thin layer of concrete is poured on top of the corrugated or flat plate and the bridge is ready for use. Suitable guard rails or similar lateral barriers can also be installed. If the bridge is erected at a location where concrete is not available, each module can be factory assembled and anti-skid material such as $\frac{1}{4}''$ or $\frac{1}{2}''$ thick floor plate, diamond plate, etc., can be secured to the flat plate (or form the flat plate as such) before or after the modules are in place.

It will be observed that the construction and erection of the bridge of the present invention does not rely on costly profiles or the assembly of a low weight, high strength but expensive framework made up of plates, angles, beams, channels and the like. Instead, the bridge is constructed of cold formed plate hoisted into place onto which a layer of concrete is poured. The result is that the bridge can be manufactured and installed at a cost which is substantially less than the manufacturing and erection of a corresponding bridge constructed in accordance with the prior art.

Further, the bridge of the present invention can be stocked in standard lengths of, say, 5 or 10 feet increments, in either standard widths or in the above-mentioned modular sizes. For a given installation a standard bridge length can then be chosen from stock and erected. If the actual bridge length is less than the standard length, the bridge can be cut to the desired length since the bridge structure, unlike prior art bridges, is uniform both in a longitudinal and a lateral direction. Thus, a shortening of a stocked bridge in no way affects its strength as rigidity, or for that matter, its appearance.

Consequently, the present invention also makes it feasible to maintain an inventory of standard bridge lengths. This in turn greatly speeds up delivery and installation times and ultimately lowers the cost of bridges.

BRIEF DESCRIPTION OF THE DRAWINGS

FIGS. 3–6 are fragmentary, front elevational views similar to FIG. 2 but show other embodiments of the present invention;

FIG. 7 is a side elevational view similar to FIG. 1 and illustrates a further embodiment of the present invention;

FIG. 8 is an enlarged, fragmentary front elevational view, in section, of the bridge illustrated in FIG. 1 and shows the installation of lateral guard rails for the bridge;

FIG. 9 is a fragmentary bottom view, in section, and is taken on line 9—9 FIG. 8; and FIG. 10 is an enlarged side elevational detail of the portion of FIG. 7 enclosed by line 10—10 and illustrates the connection of the bridge to a bridge abutment.

DESCRIPTION OF PREFERRED EMBODIMENTS

Figure 1:
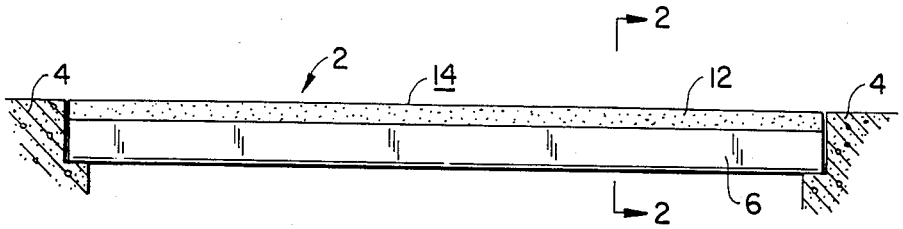
FIG. 1 is a schematic, side elevational view of a bridge constructed in accordance with the present invention.
Figure 2:
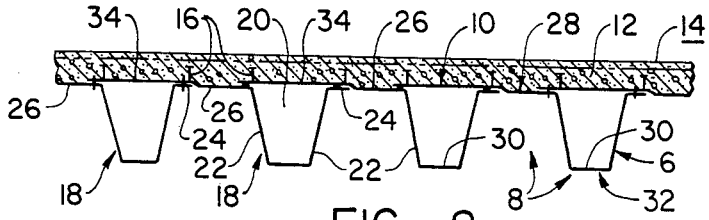
FIG. 2 is a fragmentary, enlarged front elevational view, in section, and is taken along line 2—2 of FIG. 1.

Referring to FIGS. 1 and 2, a bridge 2 constructed in accordance with the present invention is shown suspended between spaced-apart bridge abutments 4. The bridge comprises a corrugated plate 6 having a multiplicity of parallel, side-by-side corrugations 8 which extend in a longitudinal direction of the bridge, that is which run from one bridge abutment 4 to the other. The bridge further includes a flat plate 10 and a layer of concrete 12 disposed on top of the flat plate and defining a traffic carrying surface 14 of the bridge. Shear studs 16 are secured, e.g. welded to the flat plate and they anchor the concrete layer to the flat plate to thereby form a mechanically interlock between them.

In the embodiment of the bridge illustrated in FIG. 2, the corrugated plate is defined by a multiplicity of channel members 18 each of which defines an upwardly opening, generally V-shaped channel 20, that is a channel having inclined sides 22. A first, relatively narrow horizontally disposed flange 24, projects laterally from the upper end of one of the inclined channel sides while a second, relatively wide, horizontally disposed flange 26 projects laterally from the upper end of the other inclined channel side. Both flanges extend over the full length of the associated channel members. The wide flange of each channel member 18 is secured, e.g. spot, skip or continuously welded, or it is bolted to the narrow first flange 24 of the next adjoining channel member.

Thus, in the illustrated embodiment, the corrugated plate 6 is defined by the totality of channel members and the wide flanges 26 define corrugation peaks 28 of the plate while flat root sections 30 of the V-shaped channels 20 define corrugation troughs 32.

In the embodiment of the invention illustrated in FIG. 2, wide flanges 26 further define the flat plate 10 which is structurally continuous over the full width of the corrugated plate. For this purpose, the wide flanges include lateral, outboard extensions 34 which are stepped up so as to accommodate the narrow flanges of the next adjoining channel members and which have sufficient widths so as to overlap the wide flanges 26 of the adjoining channel members. In this manner, the outboard extension 34 of one channel member covers and closes the upwardly open V-shaped channel 20 of the adjacent channel member so that when concrete is poured onto the resulting flat plate the fresh concrete cannot enter the channel and the finished bridge exhibits a plurality of side-by-side, hollow tubular members which extend over its full length.

The outermost edge of the outboard extension 34 is suitably secured, preferably welded to the wide flange 26 of the next adjoining channel member 18.

The embodiment of the invention illustrated in FIG. 2 is particularly adapted for short span bridges of relatively lesser length. Thus, for a bridge having a length of 20 feet, for example, the pitch of the corrugated plate, that is the spacing between adjacent corrugation peaks 28 or corrugation troughs 32 is 30 inches while the corrugation height, that is the distance between the corrugation peaks and corrugation troughs is 12 inches. The corrugated plate has a wall thickness of 3/16th inch and a root section 30 width of 4 inches. The concrete layer height is between $3\frac{1}{2}$ to 4 inches while the shear studs 16 are made of $\frac{1}{2}$-inch diameter rod, the rod material and the plate material having a minimum yield strength of 50,000 psi. Such a bridge complies with AASHTO-HS 20-44 loading requirement.

Figure 3:
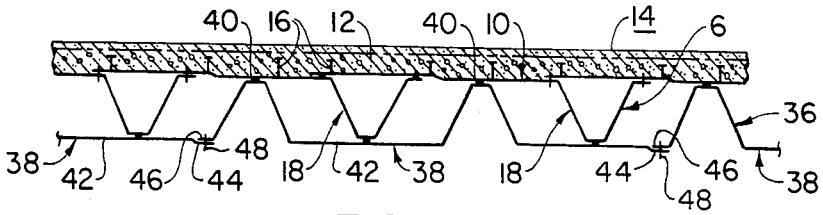

Referring now to FIGS. 1 and 3 in another embodiment of the invention, the bridge 2 is constructed in the above described manner utilizing a plurality of side-by-side, parallel channel members 18 which define corrugated plate 6 and flat plate 10 of the bridge. Placed on top the flat plate 10 is a layer of concrete 12 which defines traffic bearing surface 14. A multiplicity of shear studs 16 welded to the flat plate 10 anchor the concrete layer to the flat plate and thereby form a mechanical interlock between the two.

In addition, however, and to increase the overall strength of the bridge, a second, lower corrugated plate 36 is provided. In the illustrated embodiment, the lower corrugated plate is defined by side-by-side corrugated plate sections 38, each of which defines two full corrugations, that is two corrugation peaks 40 (which are relatively narrow) and two corrugation troughs 42 (which are relatively wide). One lateral edge of each corrugated plate section, say a righthand edge portion 44 is stepped down to nest with a mating, relatively narrow, longitudinal side flange 46 of the adjoining corrugated plate section. The overlapping plate portions are suitably secured to each other, preferably with intermittently placed bolts 48, although other means for fastening the plates together such as welds, rivets and the like may, be substituted.

The structure illustrated in FIG. 3 is functionally similar to that illustrated in FIG. 2. Again, it defines multiple, longitudinally extending tubular conduits which can be utilized as above described and which render the bridge relatively lightweight while giving it great strength and rigidity. The concrete layer is fully supported over its full width so that its thickness can be kept to a minimum. Of course, the addition of the lower corrugated plate 36 almost doubles the strength and rigidity of the bridge illustrated in FIG. 3 over that illustrated in FIG. 2.

The embodiment of the invention illustrated in FIG. 3 may, for example, be employed to conform a bridge having a span of 30 feet with AASHTO-HS 20-44 loading requirements by providing a 36-inch corrugation pitch, a corrugation height of 8 inches and a concrete layer thickness of $6\frac{1}{4}$ inch. Again the corrugated plate as well as the shear studs (dimensioned as discussed above) are constructed of steel having a yield strength of 50,000 psi. In the example the upper corrugated plate has a (trough) root section width of 2 inches and the lower corrugated plate has a root section width of approximately 26 inches.

Figure 4:
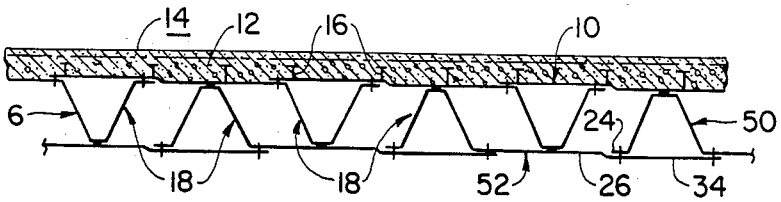

Referring now to FIG. 4, in another embodiment of the invention, the corrugated plate 6, flat plate 10 and concrete layer 12 are constructed as above described. The bridge also includes a lower corrugated plate 50 which is defined by the same channel members 18 which define the upper corrugated plate 6. The only difference between the upper and lower corrugated plates is that the channel members are inverted. Thus, the bridge illustrated in FIG. 4 also includes a lower flat plate 52 defined by wide flanges 26 together with corresponding outboard extensions 34. The upper and lower corrugated plates are suitably secured to each other with welds, bolts, rivets or the like.

A bridge constructed as illustrated in FIG. 4 has a somewhat greater strength and rigidity than the bridge illustrated in FIG. 3, primarily because the bridge includes a continuous lower flat plate 52. In all other respects the bridge is constructed and functions as described above.

It will be observed that in the embodiments of the invention shown in FIGS. 3 and 4, the upper and lower corrugated plates are nested one within the other, that is the corrugation peaks and corrugation troughs of the upper and lower corrugated plates contact and are secured to each other. As a result the overall height of the portion of the bridge defined by the corrugated plates is substantially equal to the height of one corrugated plate plus one corrugated plate thickness. This construction is particularly useful in connection with bridges having relatively high payloads yet relatively short spans where shear forces are relatively high as compared to the bending momement. For bridges of greater spans, bending moments and the rigidity of the bridge become of increasing significance and require a corresponding strengthening of the bridge.

Figure 5:
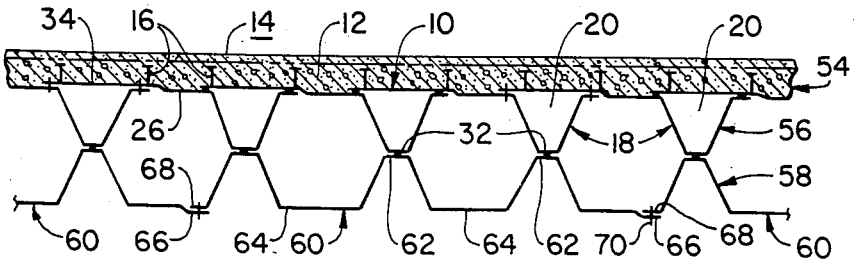

Referring now to FIGS. 5 and 7, a bridge 54 is again suspended between abutments 4, but it comprises a plurality of corrugated plate layers which are stacked one on top of the other by contacting and securing to each other corrugation troughs of the upper corrugated plate with corrugation peaks of the lower corrugated plate in the manner more fully described below.

Referring now specifically to FIG. 5, an upper corrugated plate 56 is constructed as above described from a plurality of side-by-side channel members 18 which define upwardly open, V-shaped channels 20 that are closed by wide, longitudinally extending flanges 26 fitted with outboard extensions 34 so as to close the upwardly open channels. Overlapping portions of the outboard extensions and of the wide flange of adjoining channel members are again secured, e.g. welded together to define flat plate 10 which is structurally continuous over the width of the corrugated plate. Placed on top of the flat plate 10 is the above described concrete layer 12 which defines traffic carrying surface 14 of the bridge. Studs 16 are used to mechanically interlock the concrete layer to the flat plate.

A lower corrugated plate 58 may be constructed of mutliple corrugated plate sections 60 which define parallel, side-by-side, longitudinally running corrugations having alternating, relatively narrow corrugation peaks 62 (of a width substantially equal to the corrugation troughs of the upper corrugated plate 56) and relatively wide corrugation troughs 64. One of the lateral edge portions 66 is stepped down so as to nest with short side flanges 68 of the adjoining corrugated plate section so that the overlapping portions can be secured to each other, for example, with bolts 70.

The embodiment of the invention illustrated in FIG. 5 is adapted for greater spans, say for a span of 45 feet. For AASHTO-HS 20-44 loading requirements, the corrugated plates has a 23-inch pitch, a corrugation height of 8 inches and a plate thickness of 3/16th with a yield strength of 50,000 psi. The concrete layer thickness is $6\frac{3}{4}$ inch while the upper plate has a (trough) root section width of about 2 inches and the lower plate has a root section width of about 13 inches. By increasing the corrugation height to 12" and the plate thickness to $\frac{1}{4}$" the bridge can have a span up to about 65 feet.

Referring to FIGS. 5 and 7, the lower corrugated plate 58 may extend over the full length of the upper corrugated plate 56 as is shown for the first lower corrugated plate in FIG. 7. The lower corrugated plates, however, may span a distance less than the full length of the upper corrugated plate as is the case with lower corrugated plates 72, 74 and 76 shown in FIG. 7. In such an event, ends 78 of the lower corrugated plates terminate short of abutments 4 and the plates are centered with respect to the longitudinal extent of the bridge so that they strengthen the bridge where it is subjected to greatest stress.

To prevent the accumulation of moisture and debris within and to prevent animals from gaining access to the hollow interior of the lower corrugated plate through their open ends 78, Z-shaped end plates 79 or L-shaped end plates 81 may be suitably placed over the open ends as is illustrated in FIG. 7 and secured to the adjoining corrugation.

FIGS. 7 and 10 also illustrate the manner in wich bridge 2 is supported by abutments 4. Each abutment includes a protruding ledge 120 on which is formed a pedestal 122. Ends 124 of the uppermost corrugated plate 56 and, as illustrated in FIGS. 7 and 10 of the next lower corrugated plate 58, overlap the pedestals and rest thereon. An elastomeric bearing pad 126 is interposed between the corrugated plates and the pedestal.

Preferably, each corrugated plate end 124 is defined by a generally L-shaped end plate 128 which is suitably secured, e.g. welded to the corrugated plates 56, 58 and which includes a lower, horizontal leg 130 which rests on the elastomeric bering pad. Anchor bolts 132 protrude from the abutment ledge 120 and extend through suitably placed holes in the horizontal leg of the end plate. Nuts attach the end plate and, therewith, the corrugated plates and the entire bridge to the anchor bolts and the abutment. To permit thermal expansions of the bridge the anchor bolt holes in the horizontal leg 130 of one of the end plates 128 are elongated in the direction of the length of the bridge.

Referring now to FIG. 6, in yet another embodiment of the invention, a bridge 80 is constructed of at least one upper corrugated plate 82 and one lower corrugated plate 84, each of which is constructed of corrugated plate sections 86 which define alternating corrugation peaks and corrugation troughs 88, 90 which are laterally offset by one-half corrugation pitch so that corrugation troughs of the upper plate are aligned with corrugation peaks of the lower plate. Placed directly on top of the upwardly facing surface of the upper corrugated plate is a concrete layer 92 which defines traffic carrying surface 14 of the bridge.

To anchor the concrete layer to the corrugated plate, the latter is constructed of so-called checkered plate, arranged for example in a diamond pattern so that raised protrusions 94 which are uniformly distributed over the corrugated plate and depressions defined by them face upwardly. The need for concrete anchoring studs (shown in FIGS. 2–5) is thereby eliminated. The protrusions, which typically extend upwardly from a remainder of the plate by up to ⅛th inch or more, form a uniform, i.e. evenly distributed mechanical interlock between the concrete layer and the corrugated plate and thus, integrate the latter with the former into a load bearing structure.

Since concrete has little tensional strength and since the corrugations of the upper and lower plates have little transverse strength, a flat plate 96 defined by a plurality of interconnected flat plate sections 98 is used so as to render the flat plate structurally continuous over the width of the corrugated plate. The flat plate is interposed between the upper and lower corrugated plates 82, 84 to prevent the corrugations of the plates from being opened, that is from being spread apart in a lateral bridge direction when the bridge is subjected to its design load. Thus, flat plate 96 performs the same function as the flat plates illustrated in FIGS. 2–5 but, in the embodiment illustrated in FIG. 6, it is spaced apart from the concrete layer by the upper corrugated plate. The flat plate itself is suitably secured to the corrugation troughs and peaks of the upper and lower corrugated plates, respectively, as by welding or bolting it thereto.

For a sectional or modular construction of the bridge, that is for a construction in which each corrugated plate section has a width less than the overall width of the bridge, each section is fitted with a longitudinally extending, relatively short side flange 100 along one edge of the section and a longitudinally extending, relatively wide side flange 102 on the opposite side of the section so that portions of the relatively wide flanges of the upper and lower sections overlap and can be secured, e.g. bolted to each other.

In the embodiment of the invention illustrated in FIG. 6, the upper corrugated plate is preferably constructed of checkered steel plate while the lower corrugated plate is constructed of regular steel plate, both of which have a yield stress of 50,000 psi. For the AASHTO-HS 20-44 loading requirements the plates have a thickness of 3/16th inch a corrugation pitch of between 16 to 18 inches, and a corrugation depth of between 6 and 8 inches. The flat plate 96 also has a 3/16th inch thickness while the concrete protrudes 2 to 3 inches above the corrugation peaks of the upper corrugated plate. Such a structure is suitable for span lengths of between 20 to 40 feet. Of course, by adding additional lower corrugated plates the span length of the bridge can be increased as may be required.

Referring now briefly to FIGS. 8 and 9, a longitudinally extending guard rail 104 may be installed along lateral edges 106 of the bridge by arranging over the length of the bridge a plurality of generally L-shaped channel members 108 (which may have the same profile as the corrugations of corrugated plate 6). Each channel member includes a horizontal portion 110 secured to the underside of corrugations 8 of the corrugated plate with bolts 112, for example. A vertical portion 114 of the channel member protrudes above road bed 14 and the guard rail is secured, e.g. bolted to its upper end. A gusset plate 116 is preferably bolted to the corrugated plate in alignment with the channel member and welded to the latter. It includes a protruding section 118 which is secured, e.g. welded to the channel member to rigidify its vertical portion.

We claim:

1. A bridge for carrying traffic comprising as essentially the sole load carrying members of the bridge between spaced apart supports for the bridge, a corrugated plate having side-by-side, parallel corrugations defined by alternating corrugations peaks and corrugation troughs, the corrugations being oriented in the direction of the length of the bridge and plate; plate means connected to the corrugation peaks, defining a traffic carrying surface of the bridge, being structurally continuous over substantially the full width of the corrugated plate, and having a sufficient strength and rigidity for distributing a point load applied to the traffic carrying surface in a lateral direction over a plurality of adjoining corrugations to thereby prevent a spreading apart of the corrugations under the point load; the corrugated plate being defined by multiple, side-by-side corrugated members, each such member being defined by a generally V-shaped upwardly open channel section and first and second, laterally protruding flanges continuous with the channel section, the flanges extending over the full length of the section, the first flange having a lateral extend which is less than the lateral extent of the second flange, the lateral extent of the second flange being further sufficient so as to completely cover an adjoining V-shaped channel section and overlap the second flange of such adjoining section; and means for securing overlapping portions of the second flanges of adjoining sections to each other; whereby the joined second flanges define a second plate means.

2. A bridge longitudinally suspended between spaced apart abutments for carrying traffic and comprising as the sole load carrying members between the abutments: a corrugated plate including a plurality of side-by-side corrugations. extending longitudinally between the abutments and having a generally trapezoidal cross-section, the corrugations being defined by alternating corrugation peaks and corrugation troughs each of which includes a generally flat, relatively narrow peak section, a correspondingly shaped and oriented trough section, and corrugation sides interconnecting proximate peak and trough sections, the peak sections, the trough sections and the corrugation sides being substantially parallel to the length of the corrugated plate; plate means rigidly secured to the corrugated plate and including a layer of concrete defining a traffic carrying surface of the bridge and a flat plate disposed substantially parallel and spaced apart from the surface, the concrete layer and the flat plate means being rigidly interconnected and having a sufficient rigidity so that the plate means distributes a point load applied to the traffic carrying surface in a lateral direction over a plurality of corrugations.

3. A bridge according to claim 2 wherein the flat plate is disposed generally above the corrugated plate, and including means for rigidly connecting the concrete layer directly to the flat plate.

4. A bridge according to claim 2 wherein the flat plate is disposed generally beneath the corrugated plate, and including means for rigidly securing the flat plate to an underside of the corrugated plate, and means for rigidly securing the concrete layer to an upperside of the corrugated plate.

5. A bridge according to claim 2 including at least one lower corrugated plate disposed generally beneath the first mentioned corrugated plate, the lower corrugated plate having longitudinally extending, side-by-side corrugations, and means for rigidly securing the lower corrugated plate to the upper corrugated plate so as to define between the corrugated plates a plurality of lonitudinally extending tubular members.

6. A bridge according to claim 5 wherein the lower corrugated plate is also defined by corrugation peaks and corrugation troughs defining flat peak sections and corresponding trough sections, and wherein the corrugation trough sections of the first mentioned corrugated plate are connected to the peak sections of the lower corrugated plate.

7. A bridge according to claim 5 wherein the lower corrugated plate is also defined by corrugation peaks and corrugation troughs defining flat peak sections and corresponding trough sections, and wherein the corrugation peak sections of the first mentioned corrugated plate are connected to the trough sections of the lower corrugated plate.

8. A bridge according to claim 2 wherein the corrugated plate and the flat plate are constructed of a corrosion resistant steel.

9. A bridge according to claim 2 including a plurality of lower corrugated plates disposed beneath and rigidly secured to the first mentioned corrugated plate, at least some of the lower corrugated plates having a length less than the spacing between the abutments and having ends terminating short of the abutments.

10. A bridge according to claim 2 wherein the corrugated plate and the flat plate are constructed of stainless steel.

11. A bridge for suspension between spaced apart abutments comprising as the sole load carrying and distributing members a material layer defining a generally flat traffic carrying surface, a plurality of longitudinally extending, parallel and upwardly opening channel members arranged side-by-side, each channel member including a generally horizontally disposed flange protruding laterally from an upper end of the channel member and extending over the full length of the channel member, the flange having a width greater than the lateral spacing between adjoining channel members so that portions of the flanges of adjoining members overlap and means rigidly securing overlapping portions of the flanges of adjoining channel members to each other to thereby define a corrugated plate having longitudinally extending corrugations and a substantially flat plate immediately beneath the concrete layer, the bridge further including means defining a mechanical interlock between the material layer and the flat plate so as to form a rigid, lightweight, uniform structure.

12. A bridge for carrying vehicular traffic between spaced-apart abutment means comprising as the sole load carrying members of the bridge between the abutment means a corrugated metal plate having side-by-side, parallel corrugations defined by alternating corrugation peaks and corrugation troughs, the corrugations being oriented in the direction of the length of the bridge; a flat metal plate having an effective width substantially equal to the width of the corrugated plate; means securing the flat plate to adjoing corrugations to thereby tie together adjoining corrugations and prevent them from spreading apart in a lateral direction; a layer of concrete placed on top of the corrugated plate and extending over the full length and width thereof for defining a traffic bearing surface for the bridge, the layer and the flat plate together having a sufficient rigidity so as to distribute a vehicular point load acting on the traffic bearing surface in a lateral direction over a plurality of corrugations; the corrugated plate, the flat plate and the layer of concrete being further formed and dimensioned so that the concrete layer is stressed in compression only when the bridge carries the vehicular traffic; and means forming a rigid interlock between the layer of concrete, the flat plate and the corrugated plate.

13. A bridge according to claim 12 wherein the flat plate is disposed on top of the corrugated plate and wherein the layer of concrete is disposed on top of the flat plate.

14. A bridge according to claim 13 including a plurality of post means secured to the corrugated plate and having an upwardly extending portion disposed lateral of the corrugated plate and protruding upwardly above the traffic bearing surface, and a guard rail extending parallel to the corrugations and secured to the upwardly extending portion of the post means proximate an uppermost end thereof.

15. A bridge according to claim 14 wherein the post means has an L-shaped configuration and includes a substantially horizontal portion, and including means for securing the horizontal portion to corrugation troughs of the corrugated plate.

16. A bridge according to claim 12 including at least one lower corrugated plate secured to the underside of the first mentioned corrugated plate, the lower plate having a lesser length than the first mentioned corrugated plate, and means for closing open ends of the lower corrugated plate so as to prevent the accumulation of moisture and debris therein.

17. A bridge according to claim 12 wherein the abutment means defines a generally horizontally oriented ledge for receiving and supporting respective ends of the corrugated plate, and further including a generally L-shaped end plate secured to the corrugated plate for defining the ends of the latter, the end plate including a horizontally disposed leg carried by the ledge.

18. A bridge according to claim 17 including anchor bolts protruding upwardly from the ledge; and wherein the horizontal leg is secured to the anchor bolts.

19. A bridge according to claim 18 including means defining a bearing surface for the horizontal leg interposed between the ledge and the horizontal leg.

* * * * *